US005481342A

United States Patent [19]

Arcaro et al.

[11] Patent Number: 5,481,342

[45] Date of Patent: Jan. 2, 1996

[54] PREVENTION OF EXCESS LIQUID TONER CONTAMINATION IN THE FORMATION OF ELECTROPHOTOGRAPHIC IMAGES

[75] Inventors: David J. Arcaro; John L. Hettinger, both of Boise, Id.

[73] Assignee: Hewlett-Packard Company, Palo Alto, Calif.

[21] Appl. No.: 296,398

[22] Filed: Aug. 26, 1994

[51] Int. Cl.[6] ..... G03G 15/11

[52] U.S. Cl. ..... 355/256; 118/661; 430/117

[58] Field of Search ..... 355/256, 296, 355/307; 118/261, 661, 652, 56; 430/117–119

[56] References Cited

U.S. PATENT DOCUMENTS 3,741,643 6/1973 Smith et al. ..... 355/256

3,851,964 12/1974 Smith et al. ..... 355/256

4,259,006 3/1981 Phillips et al. ..... 355/256

*Primary Examiner*—R. L. Moses

[57] ABSTRACT

Airflow is used to substantially eliminate problems cause by excess liquid toner flow in developing a latent image on a photoconductor surface. Edge effects at each end of a squeegee roller are prevented by concentrating an airstream at the nip interface of the squeegee roller with the photoconductor. Drip lines are prevented by providing a laminar airflow across the squeegee roller interface with the photoconductor to force excess toner away from the nip interface before the excess liquid can pass through the nip and cause a drip line.

13 Claims, 6 Drawing Sheets

PREVENTION OF EXCESS LIQUID TONER CONTAMINATION IN THE FORMATION OF ELECTROPHOTOGRAPHIC IMAGES

FIELD OF THE INVENTION

The present invention relates to electrophotography, particularly color hard copy printing and plotting and, more specifically, to the control of excess toner in a liquid electrophotography color printer.

BACKGROUND OF THE INVENTION

Electrophotography utilizes the formation of an electrostatic latent image to create a hard copy reproduction. In its basic aspects, a laser printing engine 124, shown schematically in FIG. 1 (Prior Art) applies a charge with a scorotron charger 136 to a moving photoconductive insulating surface area of a photoconductor 126. The surface area is exposed to a pattern of light 138, 140. A latent image of the pattern is formed on the charged surface which is then developed by application of electroscopic toner 128, 130, 132, 134 to the photoconductive material. The developed image is transferred to a hard copy medium 152 using a transfer drum 148 with a transfer corona charge unit 150 and fused, or fixed, to the medium 152 by using another transfer corona unit 154. The photoconductive material insulating surface is then erased 146, cleaned 142, 144, and reused for the next image. This basic construct is used in a variety of state of the art products such as computer printers and plotters, copiers, facsimile machines, and the like.

In the field of color hard copy reproduction, such as by laser printers using liquid electrophotography (LEP) techniques, the use of color liquid toners (generally yellow 128, magenta 130, cyan 132 (the subtractive primary colors) and a black toner 134) that are difficult to process presents challenging designs problems. Each printing cycle must charge, expose, develop, and transfer colors, several being through a toner layer that has already been deposited on the photoconductor 126. One problem inherent in the process is the managing of excess liquid toner.

Pneumatic pressure has been used to control excess liquid toner. For example, U.S. Pat. No. 3,741,643 uses an "air knife for removing excess toner from the surface of the photoconductive drum or belt." Col. 1, II. 35–36. Essentially, the forced air is used to evaporate the "diluent" part of the liquid toner.

Referring to FIG. 2 (Prior Art), another solution to the problem of dealing with excess liquid toner has been to add a squeegee roller 229 adjacent to the developer roller 228 of each developer assembly. While effective at drying the photoconductor at the surface, the squeegee roller 229 is known to leave the imaged photoconductor wet with toner at its outside edges (also known as edge effects), that is, along each end of the squeegee roller proximity area with the photoconductor 126 (FIG. 2A). This area of wet photoconductor is drawn into the next different color developer where it mixes with that toner. Over time, this color mixing, known as cross-contamination, is sufficient to seriously degrade color print quality. Various devices such as having absorbent pads, suction devices, or counter-rotating end caps at each end of the squeegee roller have provided limited success at controlling edge effects. Therefore, there is a need for an apparatus to assist squeegee roller to prevent these edge effects that lead to cross-contamination.

Moreover, it is known that a squeegee roller 229 retains a volume of toner across a substantial part of its surface area after wiping an image on the photoconductor 226. As demonstrated in FIG. 2B, a drip line of retained toner forms in the downstream nip between the squeegee roller 229 and the photoconductor 226 as the toned image pulls away from the squeegee roller 229. This volume of retained toner is known to be sufficient to contaminate the colors of the adjacent developers. Over time, the wasted toner from the drip line effect will also seriously reduce the number of pages that can be printed from a given volume of toner. Such drip lines have also been found to form on the developer roller 228. Therefore, there is also a need for an apparatus to alleviate the drip line effect problem.

SUMMARY OF THE INVENTION

In its basic aspects, the present invention presents a method and apparatus for controlling excess toner in a liquid electrophotography color hard copy machine. In a system for forming an electrophotographic image, having a moving photoconductor surface on which a latent image is formed, operatively coupled with a toner mechanism adapted to develop the latent image, a method for controlling the flow of excess toner in the image includes directing predetermined airstreams at predetermined interface localities of the photoconductor surface and the toner application mechanism such that toner edge effects and toner drip lines are substantially eliminated. Relatively low pressure pneumatic devices are used to provide the respective airflow streams.

It is an advantage of the present invention that the method of operation requires no contacting parts and thus there are no adverse wear factors.

It is an advantage of the present invention that it operates using an economical, low pressure forced air device, such as a diaphragm pump or fan.

It is an advantage of the present invention that previously wasted toner can be recycled to the developer mechanism and reused.

It is still another advantage of the present invention that employs economical, commercially available system components to provide a low cost solution.

It is yet another advantage of the present invention that excess toner is returned directly to the developer, substantially eliminating opportunities for clogging.

Other objects, features and advantages of the present invention will become apparent upon consideration of the following detailed description and the accompanying drawings, in which like reference designations represent like features throughout the FIGURES.

DESCRIPTION OF THE DRAWINGS

FIG. 2 (Prior Art) is a schematic drawing of components of an electrophotography engine apparatus as shown in FIG. 1 in which:

FIG. 8 is a schematic drawing of the present invention as shown in FIG. 7 in which:

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable.

Figure 1:
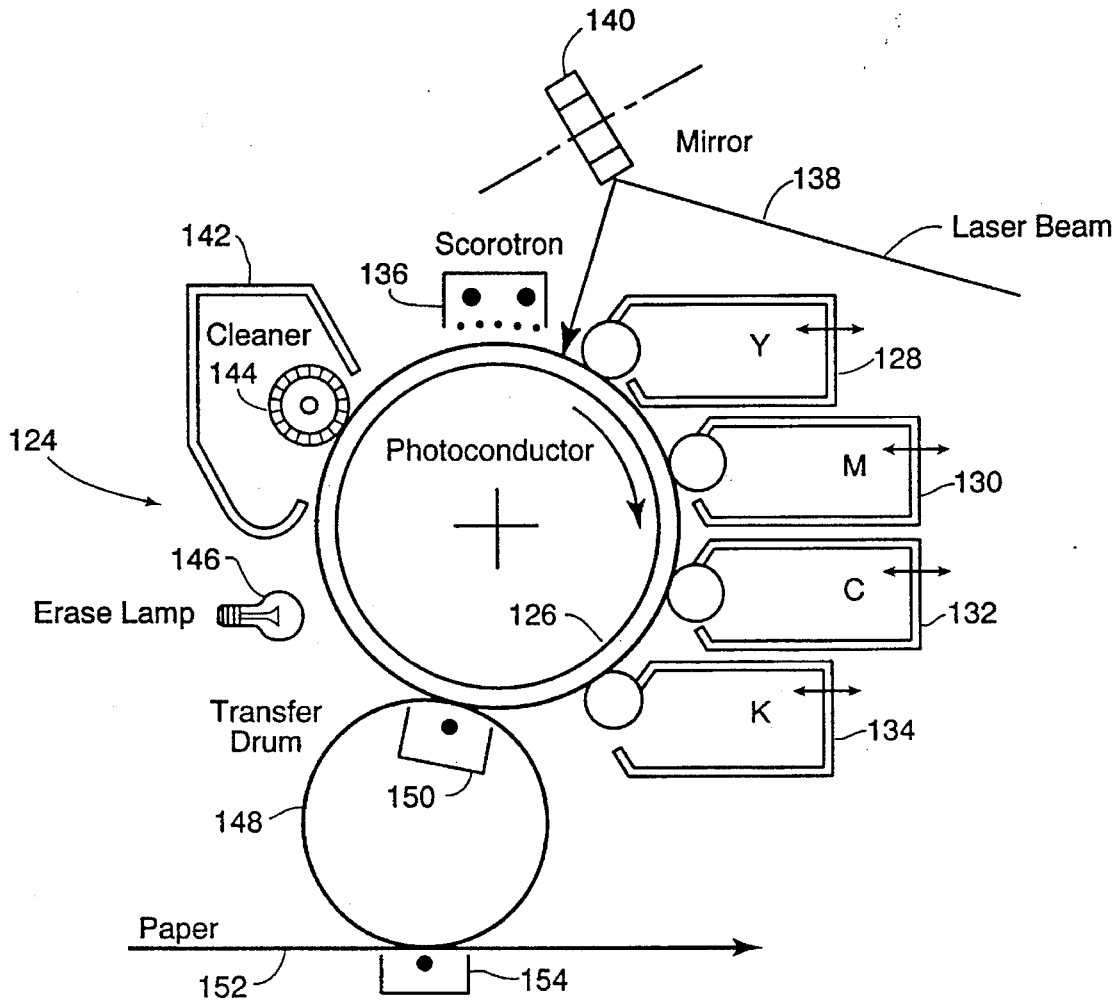
FIG. 1 (Prior Art)
FIG. 1 (Prior Art) is a schematic drawing of a laser electrophotography engine apparatus.
Figure 2A:
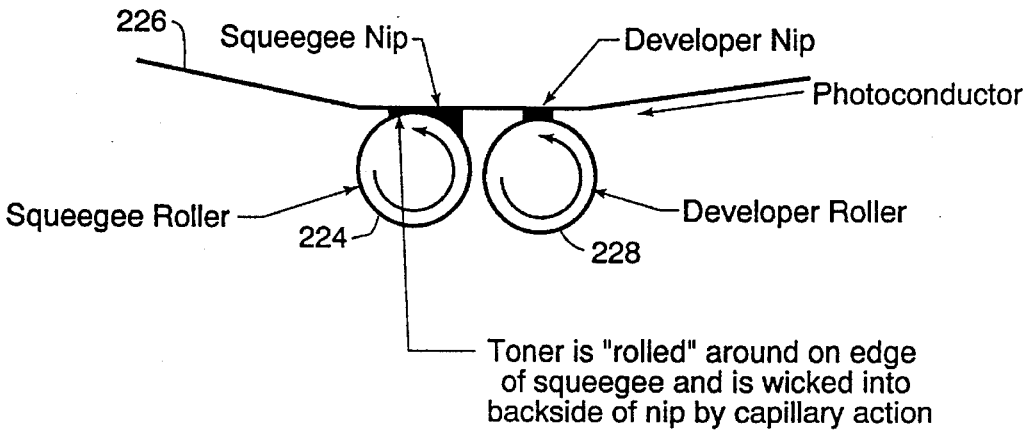
FIG. 2A (Prior Art)
FIG. 2A depicts the problem of edge effect formation.
Figure 2B:
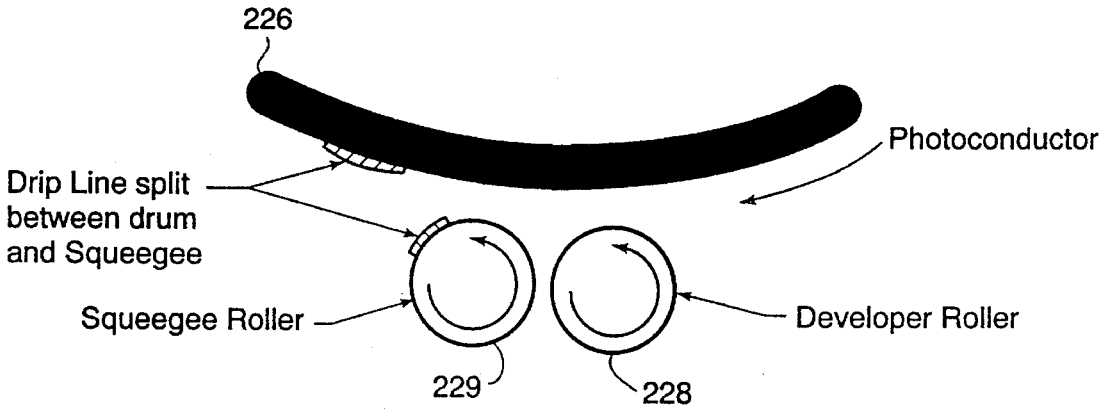
FIG. 2B depicts the problem of drip line formation.
Figure 3:
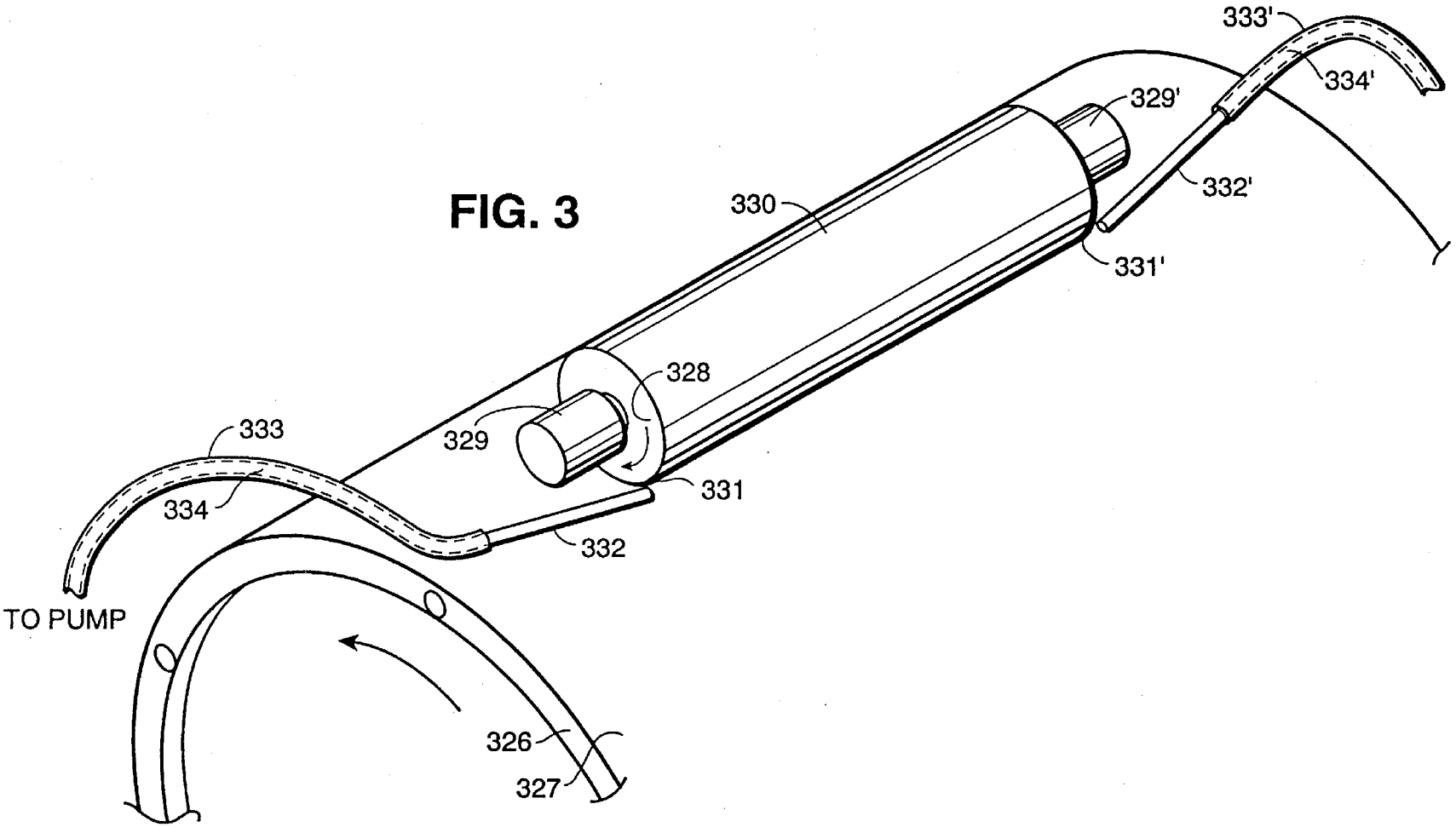
FIG. 3 is a schematic drawing, perspective view, of the present invention mechanism for substantially eliminating edge effects.
Figure 4:
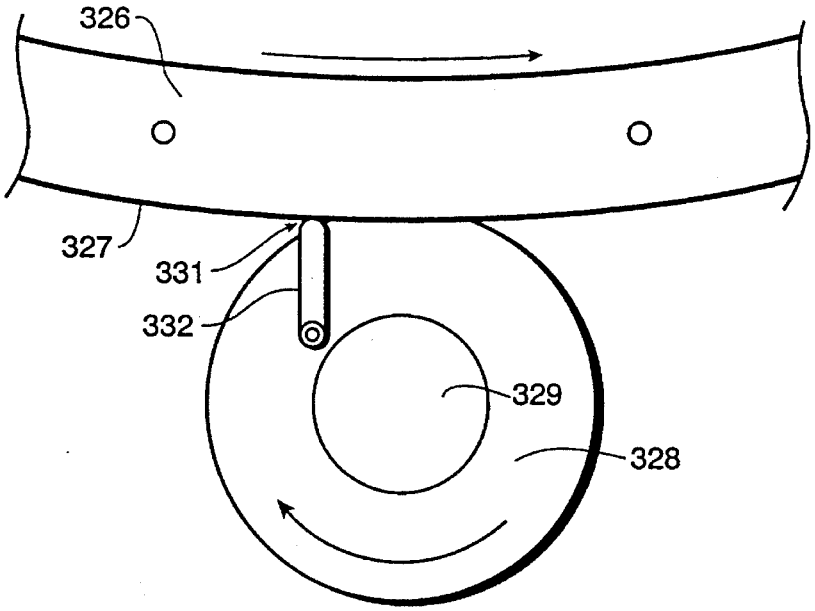
FIG. 4 is a schematic drawing, end view, of the present invention as shown in FIG. 3.
Figure 5:
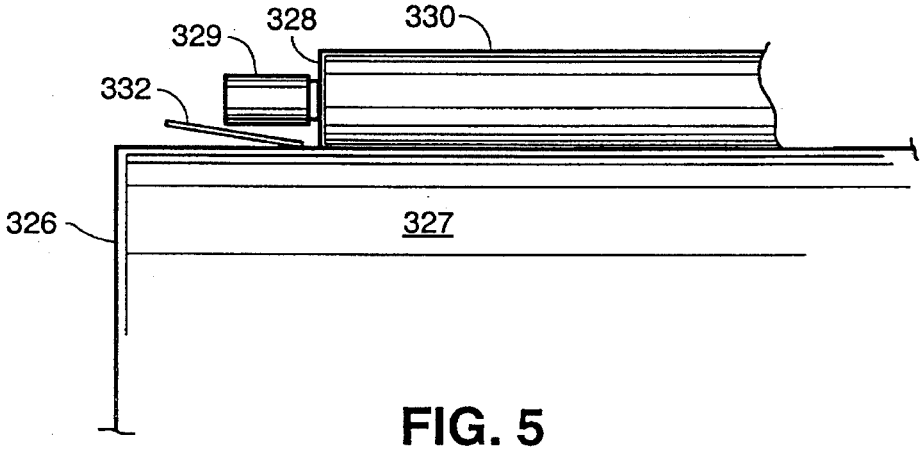
FIG. 5 is a schematic drawing, side view, of the present invention as shown in FIGS. 3 and 4.

Referring to FIGS. 3, 4, and 5, a partial section of a photoconductor drum 326, having a surface 327 on which a latent image is formed, is shown in operational relation to a squeegee roller 328. The roller 328 has hubs 329, 329' adapted for mounting to an appropriate drive mechanism (not shown). As shown in FIG. 1, the roller 328 has a surface 330 used to transfer toner from a reservoir 128 to the latent image on the drum 326. The edge effects described above with respect to FIG. 2A form at the drum-to-roller interface 331, 331' at each respective end of the roller 328.

Figure 6:
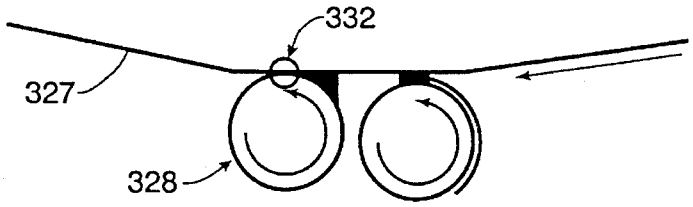
FIG. 6 is a schematic drawing, end view, of the present invention as shown in FIG. 4.
Figure 7:
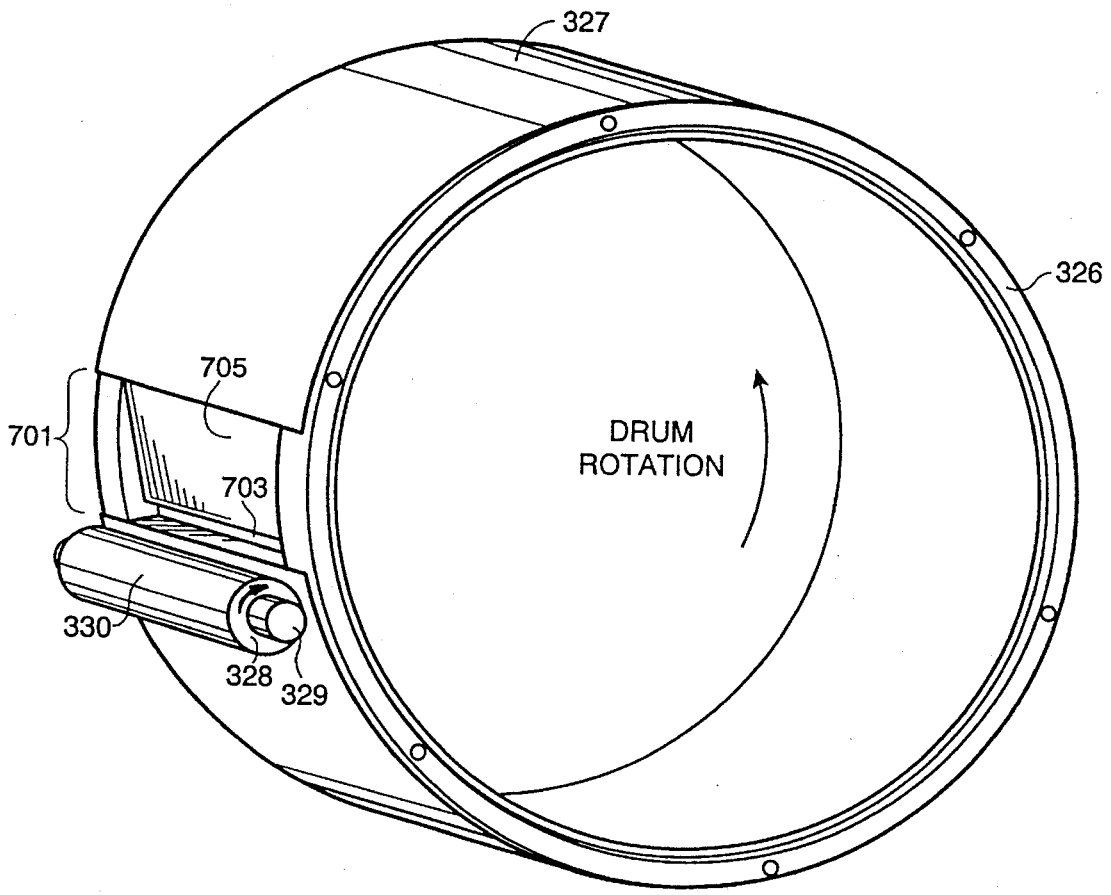
FIG. 7 is a schematic drawing, perspective view, of the present invention mechanism for substantially eliminating drip lines.

It has been found that these edge effects are substantially eliminated by directing a low pressure airstream at the front edge of the interface 331, 331'. Air nozzle devices 332, 332' are mounted (not shown) to appropriately direct the airstream. The nozzle devices 332, 332' can be custom designed and machined to meet the requirements of a specific electrophotography engine. For example, in a laser printer, it has been found that a common syringe needle can be used to provide a narrow, concentrated airstream toward the interface 331, 331'. A hose 333, 333', having a bore 334, 334', couples each nozzle device 332, 332' to a pump, such as a diaphragm pump (not shown) providing air pressure in a range of 0.5 to 5 PSI to the nozzle devices 332, 332'. The toner being squeezed between the rotating photoconductor surface 327 and the rotating squeegee roller surface 330 will have a hydrodynamic pressure outwardly directed from the upstream interface 331, 331' at each end of the two rolling surfaces' interface. The highly localized air jet directed at the interface 331, 331' nip at each end of the squeegee roller 328 prevents toner from being rolled around the edge of the squeegee roller-photoconductor interface; compare FIG. 2A with FIG. 6.

Essentially, a specific device design that forms an air dam to the upstream squeegee roller to photoconductor nip at each end of the squeegee roller-photoconductor interface can be developed within the scope of the present invention to counterbalance the hydrodynamic flow of excess toner from the nip and be tailored to the design expedient of the particular electrophotography machine in which the invention is employed. Edge effects are thereby substantially eliminated.

In FIGS. 7 and 8A through 8C, the use of air pressure to prevent the drip line problem discussed above is shown. The photoconductor drum 326 is provided with a slotted surface region 701. The slotted surface region 701 has a slot 703 and a clearance feature 705, opening the drum surface 327. In an assembled condition (not shown), the drum 326 is substantially a tubular construct through which air under pressure can be introduced, such as with a fan, leaving the slot 703 as an egress airflow from the drum 326. The slot 703 crates a laminar airflow outwardly from the drum surface 327.

Figure 8A:
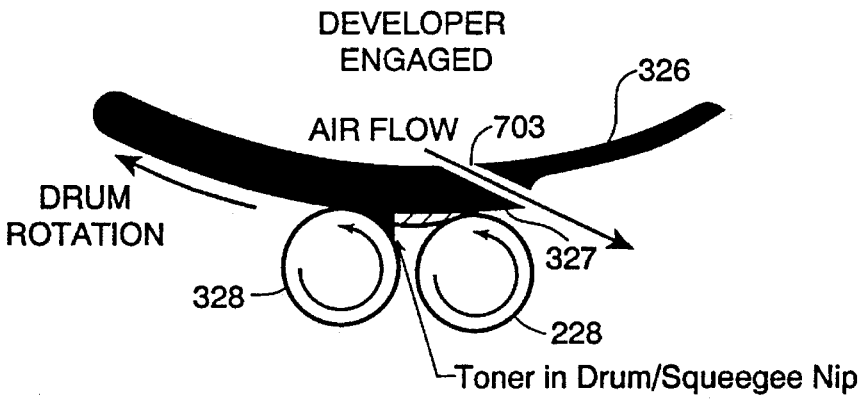
FIG. 8A is a depiction of the operation of the present invention when the developer mechanism is engaged.
Figure 8B:
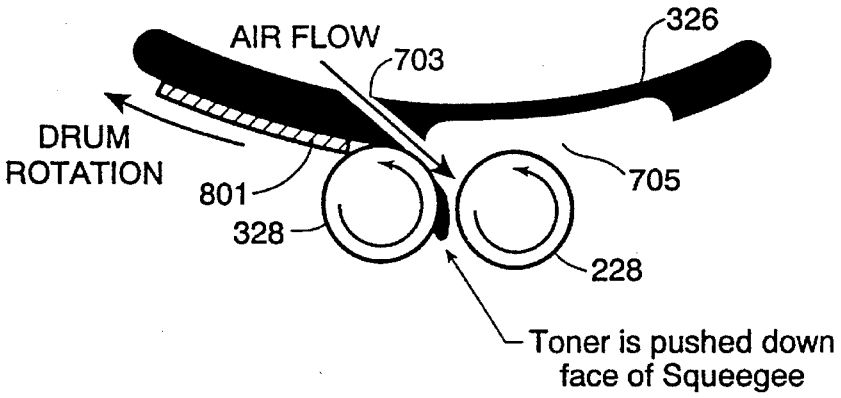
FIG. 8B is a depiction of the operation of the present invention when the developer roller has completed the transfer of toner from a reservoir to a photoconductor surface.
Figure 8C:
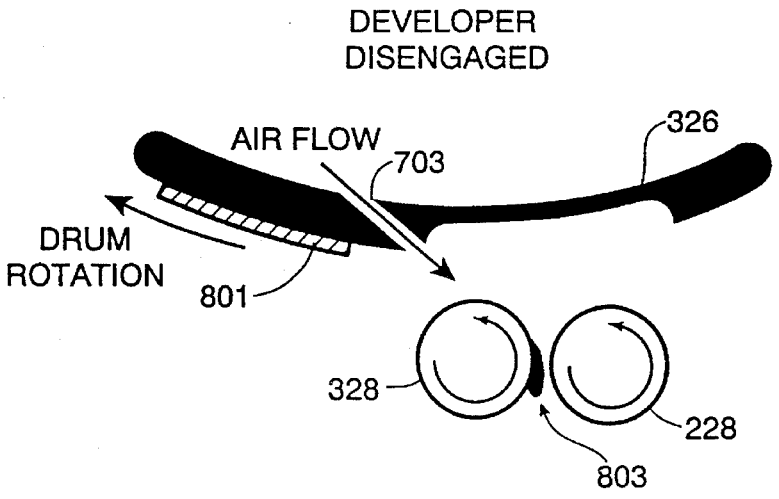
FIG. 8C is a depiction of the operation of the present invention when the developer mechanism has been fully disengaged.

The operation of the present invention is shown in FIGS. 8A through 8C. The arrow designated "Airflow" demonstrates the egress of air from the drum 326. When the developer mechanism is engaged (FIG. 8A), toner is transferred from a reservoir by developer roller 228 to the drum surface 327. The squeegee roller 328 is appropriately positioned to wipe the excess toner from the drum surface 327. The excess toner accumulates in the photoconductor drum-squeegee nip. As shown in FIG. 8B, as the developer roller-photoconductor drum nip is cleared (that is, the latent image has been fully toned with the selected toner from a reservoir), the laminar air flow, a sheet of air from the slot 703, hits the toner trapped in the upstream squeegee roller-photoconductor drum nip, pushing it down the face of the squeegee roller 328. A drip line from the toned image 801 is prevented. Referring to FIG. 8C, the excess toner 803 remaining on the squeegee roller 328 can now be removed by any suitable method and the excess toner 803 returned to the appropriate reservoir. It should be noted that the airflow will similarly prevent any drip line formed on the developer roller, although this is a less significant problem than the squeegee roller drip line effect. It has been found that only a localized low airflow rate, in the range of 0.5 to 5 cubic feet per minute through the slot 703 will accomplish the drip line prevention task.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. In a liquid toner hard copy machine, including a moving photoconductor means, means for applying toner to develop a latent image on said photoconductor means, and means for removing excess toner from said photoconductor means, a device for preventing the formation of image edge effects comprising:

pumping means for pressurizing a gas;

means, connected to said pumping means, for converting said pressurized gas into at least two concentrated streams, including a means for directing each said concentrated stream at each interface nip edge of said photoconductor means with said means for removing excess toner.

2. The device as set forth in claim 1, wherein said pumping means comprises:

a diaphragm air pump.

3. The device as set forth in claim 2, wherein said means for converting said pressurized gas comprises:

airstream nozzles adapted to direct an airstream at each interface nip edge at each end of said means for removing excess toner, and conduit means for connecting said nozzles to an output of said air pump.

4. The device as set forth in claim 3, wherein each of said airstream nozzles is adapted to provide an airstream having a predetermined pressure greater than or equal to hydrodynamic outflow pressure of liquid toner from said nip edge at an end of said means for removing excess toner.

5. A method for substantially eliminating edge effects in a liquid toner electrophotography apparatus, having a photoconductor means and a excess toner removing means adapted to remove excess toner from an image formed on said photoconductor means, comprising:

forming an air dam at each end of a nip formed between said photoconductor means and said excess toner removing means to overcome hydrodynamic force of excess toner being squeezed from each end of said nip.

6. In a liquid toner hard copy machine, including a rotating drum type photoconductor means having a central chamber and operatively coupled with means for applying toner to develop a latent image on said photoconductor means and means for removing excess toner from said photoconductor means, a device for preventing the formation of drip lines, comprising:

means for providing an airflow through said central chamber of said rotating drum;

means for converting said airflow into a laminar airflow across said means for removing excess toner such that excess toner is forced away from an upstream interface of said photoconductor means and said means for removing excess toner.

7. The device as set forth in claim 6, wherein said means for applying toner is a cooperatively rotating developer roller and said means for removing excess toner is a cooperatively rotating squeegee roller downstream of said developer roller, said means for converting comprising:

a slot through said drum adapted to direct said laminar airflow at said squeegee roller across an entire nip region between said rotating drum type photoconductor means and cooperatively rotating squeegee roller such that excess toner is prevented from passing through said nip region.

8. The device as set forth in claim 7, wherein said slot geometry is designed to provide a tangential laminar airflow across said squeegee roller.

9. The device as set forth in claim 7, wherein said slot is oriented to provide a laminar airflow to prevent a drip line between said developer roller and said photoconductor.

10. A method for controlling liquid toner flow in an image on a photoconductor surface, comprising:

forming an air dam at each end of a nip formed between said photoconductor surface and an excess toner removing means of said developer apparatus to overcome hydrodynamic force of excess toner being squeezed from each end of said nip, and directing a sheet of air across said developer apparatus following application of liquid toner to said image such that drip line effects are substantially eliminated.

11. The method as set forth in claim 10, wherein said step of directing a stream of air at an interface further comprises:

focusing a narrow air jet having a pressure in the range of 0.5 to 5 PSI at said interface.

12. The method as set forth in claim 10, wherein said step of directing a sheet of air across said developer apparatus further comprises:

creating a substantially laminar flow of air in the range of 0.5 to 5 cubic feet per minute.

13. The method as set forth in claim 10, further comprising:

providing a tangential laminar airflow across said developer apparatus.

* * * * *